US005366216A

United States Patent [19]

Ahlvin

[11] Patent Number: 5,366,216

[45] Date of Patent: Nov. 22, 1994

[54] ADJUSTABLE PRINT MATERIAL HANDLING SYSTEM HAVING AN INPUT AND OUTPUT TRAY

[75] Inventor: Eric L. Ahlvin, Vancouver, Wash.

[73] Assignee: Hewlett-Packard Company, Palo Alto, Calif.

[21] Appl. No.: 71,431

[22] Filed: Jun. 3, 1993

[51] Int. Cl.[5] ..... B65H 1/00

[52] U.S. Cl. ..... 271/171; 271/3; 271/223

[58] Field of Search ..... 271/145, 171, 207, 223, 271/3, 163

[56] References Cited

U.S. PATENT DOCUMENTS

| | | | |
|---|---|---|---|
| 3,652,083 | 3/1972 | Bosshardt . | |
| 4,340,314 | 7/1982 | Berger | 271/3 X |
| 4,560,293 | 12/1985 | McCumber et al. . | |
| 4,728,963 | 3/1988 | Rasmussen et al. . | |
| 5,181,706 | 1/1993 | Yamamoto et al. | 271/171 X |
| 5,181,713 | 1/1993 | Neugebauer . | |
| 5,184,734 | 2/1993 | Yamaguchi . | |
| 5,184,906 | 2/1993 | Czernik et al. . | |
| 5,261,651 | 11/1993 | Ishida | 271/171 X |
| 5,280,897 | 1/1994 | Maekawa | 271/223 X |

FOREIGN PATENT DOCUMENTS

| | | | |
|---|---|---|---|
| 102757 | 6/1984 | Japan | 271/171 |

*Primary Examiner*—Joseph E. Valenza
*Assistant Examiner*—Boris Milef

[57] ABSTRACT

A print material handling system is described which comprises an input tray, and an output tray, with the trays having at least one common side wall which is adjustable laterally relative to the other side wall such that adjustment of the moveable side wall simultaneously adjusts the width of the input and the output trays. As the moveable wall is adjusted, the support structures defining the bottom of the input and the bottom of the output tray are simultaneously adjusted such that the input and output trays support print material of various widths. Additionally, the invention includes at least one retractable wing positioned on one of the side walls. The wing can be manufactured in a relatively narrow width because the wing will always be positioned adjacent a print material side edge due to the simultaneous adjustment of the input and output trays.

8 Claims, 3 Drawing Sheets

ADJUSTABLE PRINT MATERIAL HANDLING SYSTEM HAVING AN INPUT AND OUTPUT TRAY

TECHNICAL FIELD

The present invention relates generally to input and output trays for printers. More particularly, the invention concerns an apparatus that provides input and output trays having at least one commonly operative adjustable side wall such that adjustment of the wall simultaneously adjusts the width of the input and output trays to accommodate various widths of print material.

BACKGROUND ART

Conventionally, printers have input trays for feeding print medium, also called print material, or print media, to a printer and output trays for receiving print medium from the printer. These input and output trays are often called cassettes. Typically, a printer may have several input trays including an input tray for 8½×11-inch print medium, 8½×14-inch print medium, and a tray to accommodate business size envelopes. In use, an operator must remove the currently employed cassette and insert the new cassette each time print material of a different dimension is fed to the printer. This system of numerous input cassettes resulted in added expense to the operator who was required to purchase a cassette for each size print material used. The numerous input cassette system also required ample storage space for storing the extra input cassettes during nonuse. Additionally, the system resulted in operator inefficiency in that the operator was required to repeatedly remove and insert different sized input cassettes.

To increase efficiency, input trays were developed having an adjustable wall such that a single input tray would accommodate various sized print material for feed to a printer. Copiers were manufactured with adjustable guide rails such that the feed area of the copier could be adjusted for the input of various sized print material. This design of an adjustable input tray or input feed area resulted in improved operator efficiency and a lower manufacturing cost over the multiple input tray design. However, in the adjustable input tray design, as the input tray size was adjusted, the output tray dimensions were unchanged.

In printers that use a wet ink printing process, freshly printed ink on print material must be given sufficient time to dry before a second sheet of print material is fed from the printer onto the top of the freshly printed material. If the ink is not dry, it will be smeared by the sheet placed on top of the still wet sheet. In response, printer output trays were designed with wings extending inwardly from each side of the output tray. In operation, a freshly printed sheet is fed from the printer onto the wings. The sheet is held on the wings for a sufficient time such that the sheet below is allowed time to dry. After a sufficient time has elapsed, the wings retract allowing the sheet to fall onto the sheet below. After a sheet has been allowed to fall off the wings, the wings are moved up into the engaged position and the printer output feeds another sheet onto the wings, thereby repeating the process.

Due to the various sizes of print material, the wings were made relatively wide such that wings of the fixed dimension output trays could support various sized print material. This wide wing design required the wings to be fully retracted before a wide sheet of print material could fall into the output tray. For typical pivoting type wings, the output tray was required to have a sufficient depth such that the output tray could hold a stack of output print material while still allowing sufficient space for the wide wing to pivot downwardly without contacting the stack of print material held in the output tray. In another wing design, the wings are mounted on the floor of the output tray and retract upwardly toward the top on the output tray. The wide wing must be fully retracted toward the output tray side wall before wide sheets of print material can fall into the output tray. Such a wing design is described in U.S. Pat. No. 4,728,963, to Rasmussen et al., entitled "Single Sheet Ink-Jet Printer With Passive Drying System". Additionally, the wide wing design required a relatively large amount of raw material to manufacture the wing, and therefore increased the costs of such output trays. Furthermore, the wide wing design required that both wings be moveable to allow a freshly printed sheet to fall into the output tray.

DISCLOSURE OF THE INVENTION

The invented print material handling system represents a solution to the problem of a printer output tray which does not correspond to the dimensions of the printer input tray. Specifically, the invention includes an input and an output tray having at least one common adjustable sidewall wherein adjustment of the common wall simultaneously adjusts the dimensions of the input and the output trays. Simultaneous adjustment of the input and the output trays results in operator efficiency and a lower manufacturing cost. In addition, simultaneous adjustment of the common wall ensures the output tray is generally the same dimension as the input tray, such that side edges of print material fed into the output tray lie generally adjacent the side walls of the output tray. Due to the close proximity between the edge of the sheet material and the side wall of the output tray, wings on the output tray can be manufactured in a relatively narrow width while still supporting print material fed onto the wings. Also due to this narrower wing design, pivotal wings require less space, thereby allowing output trays to be manufactured having a depth less than that of prior art output trays. In addition, due to the narrow width of the wings, print material more easily falls off the wings, such that only one retractable wing is necessary. Thus, the design results in lower manufacturing costs and a lesser likelihood of mechanical breakdown.

These and additional objects and advantages of the present invention will be more readily understood after a consideration of the drawings and the detailed description of the preferred embodiment.

Figure 1:
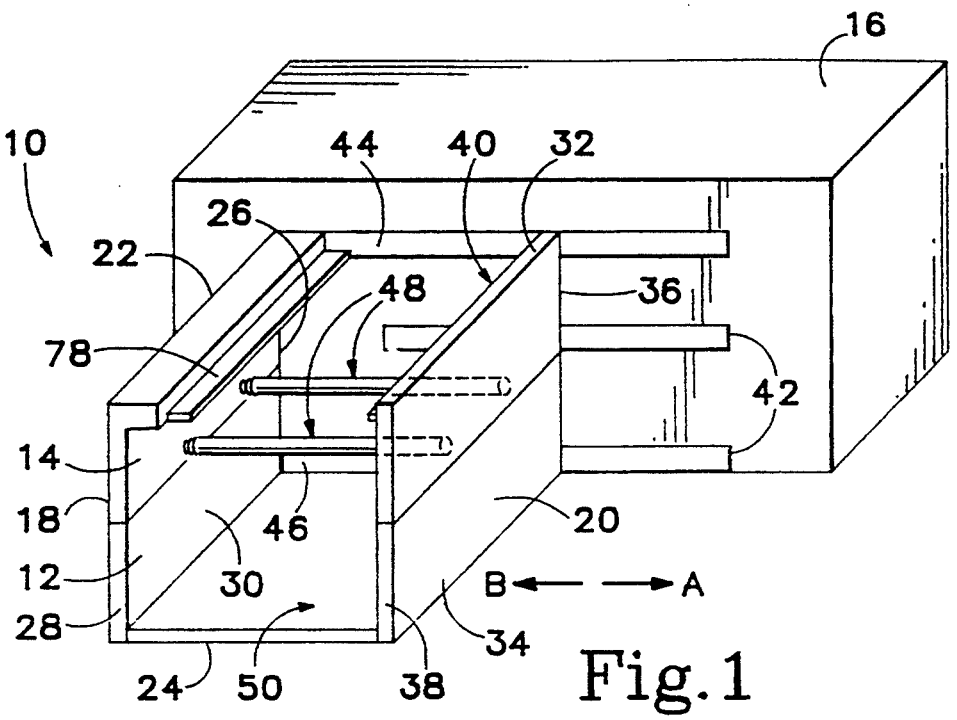
FIG. 1 discloses the print material handling system operatively associated with a printer.

DETAILED DESCRIPTION OF THE PREFERRED EMBODIMENTS AND BEST MODE OF CARRYING OUT THE INVENTION

The print material handling system, 10, of the present invention includes an input region, or input tray 12, and an output region, or output tray, 14. The trays can also be referred to as cassettes. The print material handling system is attached to a printer, 16, such that print material is fed from the input tray to the printer, the print material is printed upon, and thereafter the print material is fed to the output tray.

By printer 16 applicant means a traditional printer, such as an ink-jet printer, a facsimile machine, a copy machine, and any other type of device wherein sheet material has an image placed thereon. By print medium, or print material, applicant means Mylar®, paper, cardboard, envelopes, transparencies, or any other type of material used in the printers listed above.

In the preferred embodiment, the print material handling system, 10, comprises a first side wall 18 and a second side wall 20. In the preferred embodiment, wall 18 is stationary, and fixedly attached to printer 16. Wall 20 is adjustable relative to wall 18 such that wall 20 is laterally moveable toward and away from wall 18. In she preferred embodiment, stationary wall 18 includes a top region 22, a bottom region 24, a back wall 26 attached to printer 16, a front edge 28, and an inner surface 30, facing wall 20. Wall 20 includes a top region 32, a bottom region 34, a back edge 36 adjacent printer 16, a front edge 38, and an inner surface 40 that faces wall 18. In the preferred embodiment, back edge 36 of adjustable wall 20 is operatively associated with tracks 42 in printer 16 such that back edge 36 moves along the tracks as the wall is adjusted. Additionally, tracks 42 may include indentations (not shown) such that as wall 20 is moved along tracks 42, the wall is easily positioned in predefined typical print material widths to accommodate envelopes, 8½-inch wide sheets of print material and the like.

In the preferred embodiment, an output slot 44 of printer 16 is positioned generally adjacent the back edges and top regions of the side walls, such that print material fed from the printer is conveyed through the output slot and into the invented print material handling system. Additionally, an input slot 46 of printer 16 is positioned generally adjacent the back edge and lower portions of the side walls, such that print material is fed from the print material handling system into the printer through the input slot. In the preferred embodiment, input slot 46 is positioned below output slot 44, which is the traditional arrangement of input and output slots on printers.

In a typical construction, side walls 18 and 20 are approximately 3 to 6-inches in height measured along the front and back edges, and preferably 4-inches in height. The side walls are approximately 14-inches in length, measured along the top and bottom regions of the side walls so that the tray can support sheets 14-inches in length.

The printer paper handling system, in its preferred embodiment, is manufactured of plastic through conventional injection molding processes. However, any suitable material can be used to manufacture the system.

Print material handling system 10 further comprises floors 48 and 50, also called supports, or support structures. In the preferred embodiment, support 48 and the upper region of the side walls define output tray 14, shown in FIG. 2. Support structure 50 and the lower region of the side walls define input tray 12.

Figure 4A:
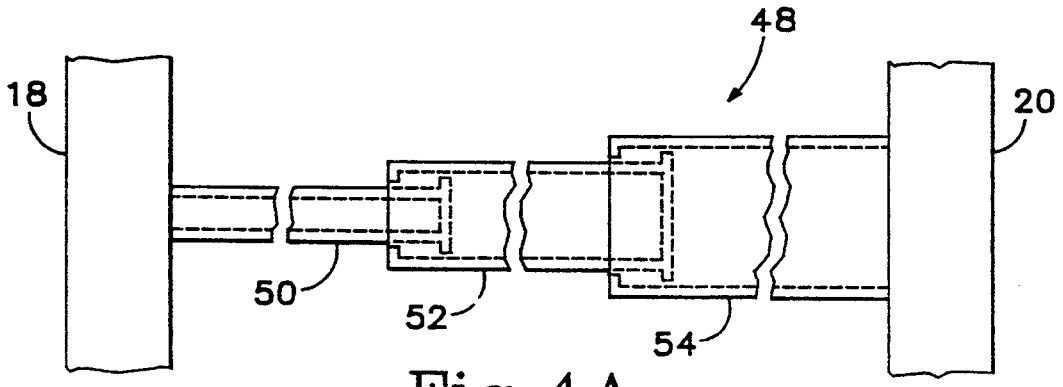
FIGS. 4A and 4B disclose a print material support structure of the system of FIG. 1.
Figure 4B:
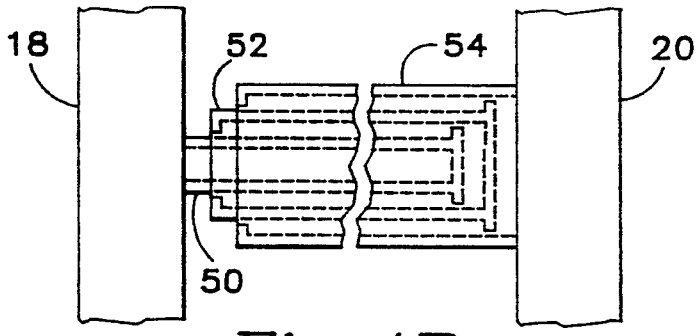

Floors 48 and 50 are typically adjustable as wall 20 is moved laterally relative to wall 18. As wall 20 is moved in direction A floors 48 and 50 adjust so that the floors extend from wall 18 to wall 20. As wall 20 is moved in direction B, floors 48 and 50 contract so that they extend from wall 18 to wall 20. FIG. 4A discloses support 48 as adjustable wall 20 has been moved in direction A (refer to FIG. 1). FIG. 4B discloses support structure 48 when adjustable wall 20 has been moved in direction B (refer to FIG. 1 ).

In the preferred embodiment, support 48 comprises tubular segments which are telescopically, or slidingly, fittingly received within one another. Specifically, as shown in FIG. 4A, support 48 comprises a small outer diameter tube 50, fittingly received within a larger diameter tube 52, which in turn is fittingly received with an even larger diameter tube 54. In the preferred embodiment, tube 50 is approximately ½-inch in outer diameter, tube 52 is approximately ¾-inch in outer diameter, and tube 54 is approximately 1-inch in outer diameter. Tube 52 has an inner diameter larger than ½-inch, and tube 54 has an inner diameter larger than ¾-inch, such that the tubes are fittingly received in one another. Due to the slidably engageable arrangement of the tubes, floor 48 extends between walls 18 and 20 when wall 20 is positioned away from wall 18, as in FIG. 4A, and when wall 20 is positioned generally close to wall 18, as in FIG. 4B. Tubes 50, 52 and 54 are collectively referred to as an elongate member that extends between the side walls. In the preferred embodiment, to fully support print material received from output slot 14, a plurality of elongate members are used, the members spaced along the length of the side wall from the front to the back of the tray. Typically, two spaced elongate members extend between the side walls in a generally parallel relationship, as shown in FIG. 1. Use of two elongate members adequately supports the print material when the sheets are dropped off the wings into the output tray while use of two members minimizes the raw material needed to manufacture support 48.

Figure 5A:
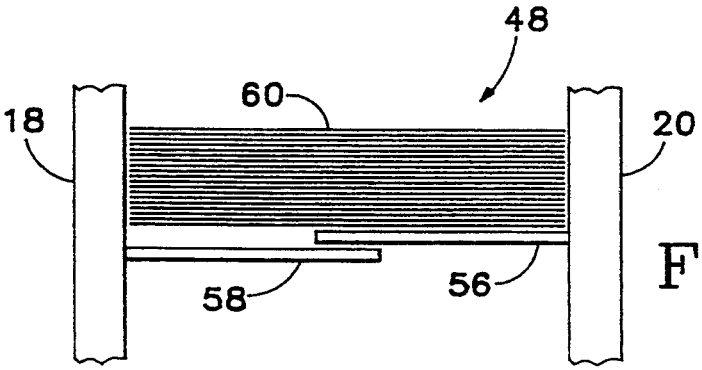
FIGS. 5A and 5B disclose another embodiment of a print material support structure.
Figure 5B:
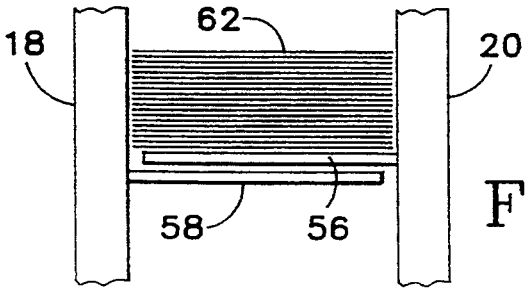

FIGS. 5A and 5B disclose a side view of another embodiment of support 48 which comprises a first shelf 56 slidable above a second shelf 58. FIG. 5A shows support 48 in an extended position, with wall 20 positioned generally away from wall 18, such that both shelves support a stack of print material 60. FIG. 5B discloses shelf 56 completely covering shelf 58, such that a narrow stack of print material 62, such as envelopes, is held on shelf 56 between walls 18 and 20.

Figure 6A:
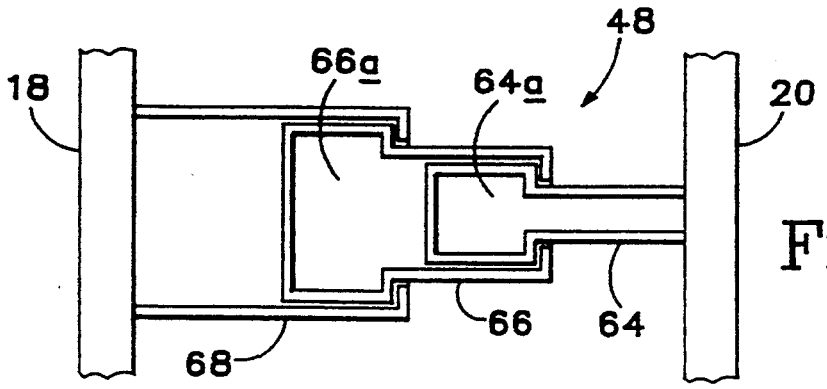
FIGS. 6A and 6B disclose yet another embodiment of a print material support structure.
Figure 6B:
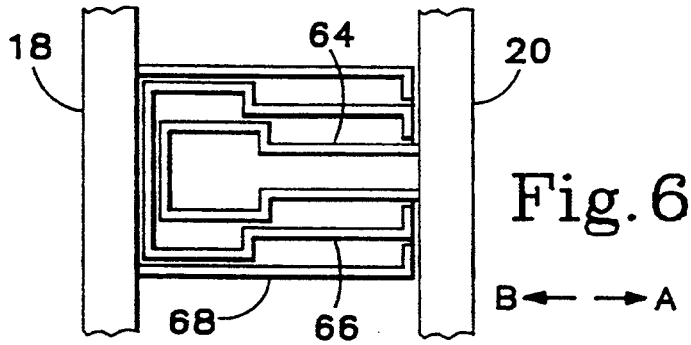

FIGS. 6A and 6B disclose a top view of another embodiment of support 48. This embodiment includes nesting arms 64, 66 and 68. Arm 64 includes an enlarged edge portion **64*a* fittingly received within arm 66. Arm 66 includes an enlarged edge region 66*a* which is fittingly received within arm 68. FIG. 6B discloses the nesting arm arrangement wherein arm 64 is positioned substantially above arm 66, and arm 66 is positioned substantially above arm 68. In this arrangement, moveable wall 20 has been moved in direction B such that the wall is generally narrowly closer to wall 18**. This nesting arm arrangement provides a relatively wide area of support for a stack of print material and can, in one embodiment, extend from the back to the front of the input and output trays.

Figure 7A:
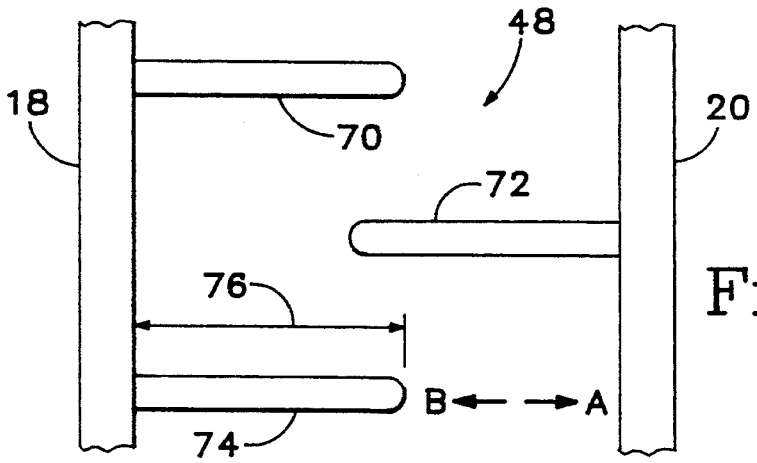
FIGS. 7A and 7B disclose still another embodiment of a print material support structure.
Figure 7B:
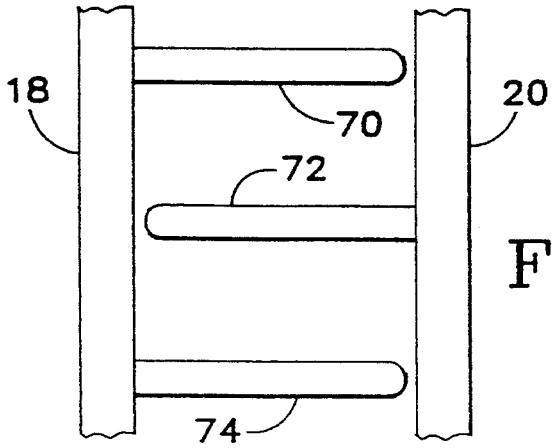

FIGS. 7A and 7B disclose a top view of yet another embodiment of support 48. In this embodiment, the support comprises plural spaced elongate members which are not slideably receivable within one another. Specifically, the support comprises three elongate spaced members positioned generally parallel to each other, with central member 72 attached to one side wall, and with outer members 70, 74 attached to the opposite side wall. Members 70, 72 and 74 have a predetermined length generally indicated as 76. In the expanded position, with wall 20 and wall 18 spaced relatively widely apart, the members can support print material having a width generally twice as long as the length of each individual member 76, as shown in FIG. 7A. In the retracted position, with walls 18 and 20 spaced relatively narrowly closer to each other such that they are approximately a distance 76 apart, support 48 can support a narrow width stack of print material such that each side edge of the narrow stack is adjacent a side wail of the tray as shown in FIG. 7B.

In the preferred embodiment, support 50 and a region of side walls 18 and 20 define the input tray or cassette 12. Typically, support 50 comprises overlapping shelves, such as shelves 56 and 58 shown in FIGS. 5A and 5B. This overlapping shelf design is typically used for the input tray so that the underside of a stack of print material is completely supported such that a sheet of print material is generally flat when fed into input slot 46 of printer 16, to maximize print quality. However, any of the above disclosed embodiments for the support structure can be utilized within the spirit and scope of the invention.

Additionally, structure 50 can comprise a solid flat expanse (not shown) such that side wall 20 is moved above the expanse, with bottom region 34 positioned on top of and generally adjacent the flat expanse of support 50. In this alternative embodiment, the moveable side wall is slidable over the support, such that only a portion of support 50 is used to support print material stacks of generally narrow widths. A generally larger portion of the flat expanse of support 50 is utilized to support a stack of print material when a wide stack is held within the input tray. In this solid expanse embodiment, support structure 50 may include tracks and indentations defining preferred lateral positions or spacings (not shown), such that wall 20 is easily positioned on the expanse at distances from wall 18 for typical paper widths, such as for envelopes and for 8½-inch wide sheets of print material.

As disclosed thus far, structure 48 and the upper portion of side walls 18 and 20 define the output tray whereas structure 50 and the lower portion of side walls 18 and 20 define the input tray. However, those skilled in the art will realize that the locations of the input and output slots can be switched such that the input tray is positioned above the output tray. Additionally, multiple floors or supports can be positioned extending between the side walls such that multiple input or output trays are defined within print material handling system 10.

In the preferred embodiment, wall 18 is stationary whereas wall 20 is adjustable, such that the adjustable wall is aligned with an operator's right hand, the hand typically used to adjust such mechanisms. However, wall 18 may be adjustable with wall 20 being the stationary wall. In yet another embodiment, both walls 18 and 20 may be adjustable. The one-adjustable-wall embodiment is the most cost efficient and has a lower risk of mechanical failure than the two-adjustable-wall design due to less moving parts and due to ease of manufacturing.

Print material handling system 10 further includes a retractable, or moveable, wing 78 positioned on top region 22 of stationary wall 18. The system also includes a fixed wing 80 (refer to FIG. 2) positioned on top region 32 of moveable wall 20. In the preferred embodiment, retractable wing 78 is pivotally mounted to side wall 18 such that wing 78 pivots in direction C (see FIG. 2) to a retracted position (shown in phantom). In this retracted position, the wing no longer supports a sheet of print material, thereby allowing the sheet to fall off the fixed wing and into the output tray 14. Thereafter, wing 78 is moved in direction D to an engaged position, for accepting the next sheet of print material from the printer. In the preferred embodiment, retractable wing 78 extends generally the length of side wall 18 along top region 22 and is approximately 1-inch in width, extending outwardly above output tray and toward opposite side wall 20. Typically, fixed wing 80 extends generally the length of side wall 20 along top region 32, and is approximately ½-inch in width, extending outwardly over the output tray, and toward opposite side wall 18.

In yet another embodiment, retractable wing 78 retracts into wall 18 such that the top surface of the wing remains generally horizontal. The pivotal movement of a typical wing construction is preferred because the sheet will tend to fall off the wings, due to the wings' non-horizontal position, earlier than if the wing remains generally horizontal during retraction. Thus, in the pivotal wing embodiment, the wing can be more quickly returned to its upright position while ensuring the printed sheet has fallen into the output tray. In addition, there are less frictional forces between a downwardly pivoting wing and a sheet than between a horizontally retracting wing and a sheet horizontally placed thereon.

Figure 2:
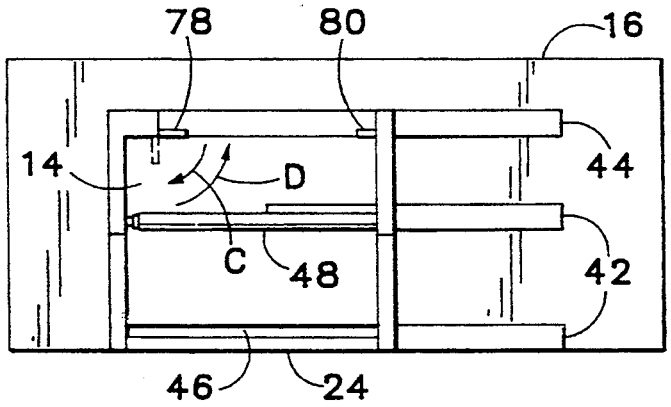
FIG. 2 discloses an end view of the print material handling system of FIG. 1.
Figure 3:
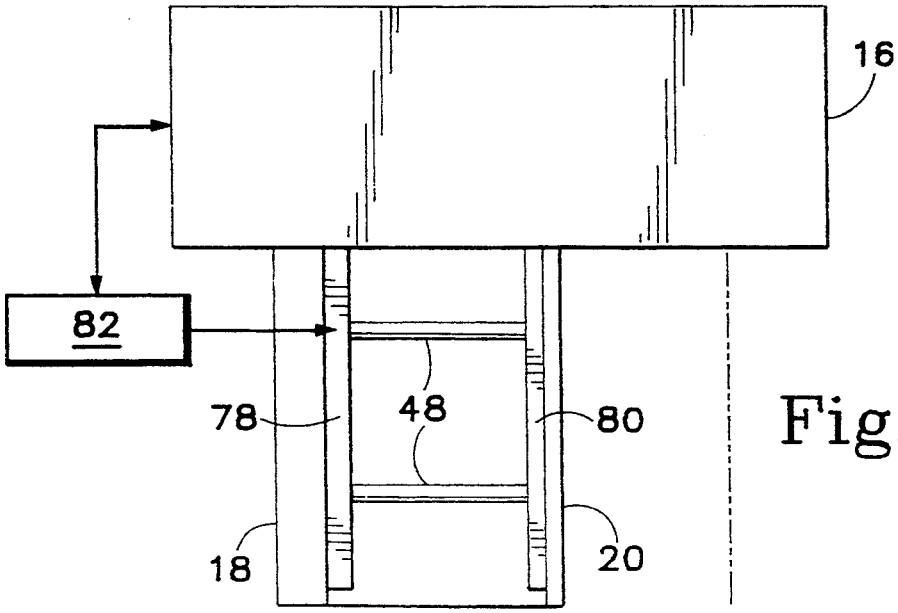
FIG. 3 discloses a top view of the print material handling system of FIG. 1.

Print material handling system 10 further includes a drive mechanism 82, shown schematically in FIG. 3. The drive mechanism is coupled to the moveable wing such that the drive mechanism moves wing 78 in direction C, shown in FIG. 2, allowing a sheet of print material to fall off the wings. Thereafter, the drive mechanism moves the wing in direction D to an engaged position, for receiving another sheet of print material. Typically, the drive mechanism is operatively associated with the printer such that the retractable wing is in the engaged position as a sheet is fed through the output slot of printer 16. In the preferred embodiment, drive mechanism 82 is positioned within stationary wall 18 to achieve a compact and efficient design. In another embodiment, drive mechanism 82 may be physically located within printer 16.

In another embodiment, the retractable wing can be positioned on the adjustable side wall, whereas the stationary wing may be positioned on the stationary sidewall. Additionally, the print material handling system handling system may include two retractable wings, or multiple retractable wings for multiple trays.

In use, an operator adjusts moveable side wall 20 to simultaneously define an input tray 12 and an output tray 14 such that the output tray has substantially the same width as the input tray. For example, when the operator desires to print on an 8½×11-inch sheet of print material, the operator moves the adjustable wall approximately 8½-inches from the stationary wall, such that the stack of print material will fit inside input tray 12, and such that the side edges of the stack lie generally adjacent the inner surfaces 30 and 40 of side walls 18 and 20, respectively. In this position, output tray 14 will also be approximately 8½-inches in width, measured between inner surfaces 30 and 40, for receiving sheets of print material from the output slot 44 of the printer 16. In this position, wings 78 and 80, shown in FIG. 2, are positioned a distance apart which is less than 8½-inches such that when a sheet of print material is conveyed out of the output slot 44 of the printer, the sheet of print material will be supported on the wings.

After the sheet is held on the wings a sufficient time for a printing on a sheet below to dry, the drive mechanism rotates wings 78 in direction C, allowing the sheet to fall into the output tray and onto the previously printed sheet. Thereafter, retractable wing 78 is pivotally moved in direction D to the engaged position, ready to receive another sheet of print material from the output slot. Due to the generally vertical drop of sheets off the wings into the output tray, a stream-lined support can be utilized including only two plural parallel spaced elongate members. Print material in input tray 12 is substantially supported by structure 50, such that print material fed to the printer through input slot 46 is generally flat, to facilitate high quality printing. As adjustable wall 20 is moved laterally away from or toward stationary wall 18, supports 48 and 50 are simultaneously adjusted thereby supporting various widths of print material held within the trays. Due to the substantially matching dimensions of the output and input trays, the wings can be manufactured in a narrow width because the side walls of the output tray will be positioned generally adjacent the side edges of print material conveyed out of the printer such that the narrow wings will support the print material.

Industrial Applicability

The invented apparatus, for simultaneously adjusting the width of input and output trays to accommodate various widths of print material, increases operator efficiency because only one adjustment is required for both input and output trays. Additionally, manufacturing efficiency is improved due to less raw material used to manufacture the apparatus. Specifically, less raw material is needed to manufacture the wings of the present invention because the wing's width is narrower than wing width of the prior art. Additionally, less raw material is used to manufacture support 48 because tubes or other such embodiments are employed, instead of a solid floor. Another advantage of the invention is that the apparatus is simple to use because an operator can quickly determine how to load various widths of print media into the trays.

While the present invention has been shown and described with reference to the foregoing operational principles and preferred embodiment, and it will be apparent to those skilled in the art that other changes in form and detail may be made therein and that the invention may be used in other low-cost print material-processing equipment without departing from the spirit and scope of the invention as defined in the appended claims.

I claim:

1. A print medium handling system comprising:

a stationary, side wall;

a moveable side wall, the moveable side wall facing the stationary side wall and being moveable laterally relative to the stationary side wall to define various widths therebetween; and plural support structures extending between the side walls, a first of the plural support structures combining with opposing regions of the side walls to form an input tray therebetween to hold print medium for feeding to a printer, and a second of the plural support structures combining with other opposing regions of the side walls to form an output tray therebetween for receiving print medium from a printer, the output tray and the input tray having common side walls such that the output tray has substantially the same width as the input tray, and such that movement of the moveable side wall adjusts the width of the support structures such that the support structures can support print medium of various widths.

2. The print medium handling system of claim 1 wherein the system further comprises a drive mechanism operatively associated with a retractable wing, the wing positioned on one of the side walls and generally above the output tray, and a stationary wing positioned on the other side wall and generally above the output tray such that print media from the printer is received on the wings, and thereafter the drive mechanism retracts the retractable wing, allowing the print media to fall off the wings and into the output tray.

3. The print medium handling system of claim 1 wherein at least one of the support structures includes plural spaced elongate members extending between the side walls.

4. The print medium handling system of claim 1 wherein at least one of the support structures includes plural elongate pairs of members, each pair including a first member and a second member, the first member slidable adjacent the second member such that movement of the moveable side wall varies the support structure width.

5. A print medium handling system comprising:

a first side wall having a substantial, first inner surface;

a second side wall having a substantial, second inner surface facing the first inner surface of the first side wall;

a first print medium support structure extending between the first and second side walls to define an input tray which holds print medium between the side walls before feeding to a printer; and a second print medium support structure extending between the first and second side walls to define an output tray for receiving print medium between the side walls after printing;

one of the side walls being adjustable relative to the other side wall so as to vary the width of the support structures.

6. The print medium handling system of claim 5 wherein the system further comprises a drive mechanism coupled to a moveable wing, the moveable wing positioned generally above the output tray on the first side wall, a second wing positioned generally above the output tray on the second side wall such that print media from the printer is received on the wings, and thereafter the drive mechanism moves the moveable wing allowing the print media to fall off the wings and into the output tray.

7. The print medium handling system of claim 5 wherein at least one of the support structures includes plural spaced elongate members extending between the side walls.

8. The print medium handling system of claim 5 wherein at least one of the support structures includes plural generally parallel elongate pairs of members, each pair including a first member and a second member such that adjustment of the adjustable side wall moves the first member generally parallel to the second member thereby varying the support structure width simultaneously with adjustment of the side wall.

* * * * *